US008257469B2

(12) United States Patent
Meister

(10) Patent No.: US 8,257,469 B2
(45) Date of Patent: Sep. 4, 2012

(54) ELECTROSTATIC FILTER

(75) Inventor: Jörg Meister, Matzendorf (CH)

(73) Assignee: Meister Environment Technology Ltd., Zug (CH)

( * ) Notice: Subject to any disclaimer, the term of this patent is extended or adjusted under 35 U.S.C. 154(b) by 666 days.

(21) Appl. No.: 12/406,240

(22) Filed: Mar. 18, 2009

(65) Prior Publication Data

US 2010/0236412 A1 Sep. 23, 2010

(51) Int. Cl.
*B03C 3/74* (2006.01)

(52) U.S. Cl. ..... 96/39; 55/DIG. 38; 96/40; 96/51; 96/88

(58) Field of Classification Search ..... 96/30, 31, 96/39, 40, 51, 88, 90; 55/DIG. 38
See application file for complete search history.

(56) References Cited

U.S. PATENT DOCUMENTS

| | | | | | |
|---|---|---|---|---|---|
| 1,478,798 | A * | 12/1923 | Schmidt | 96/25 |
| 1,794,074 | A * | 2/1931 | Hedberg et al. | 96/29 |
| 1,869,335 | A * | 7/1932 | Day | 95/77 |
| 2,486,877 | A * | 11/1949 | Ransburg et al. | 96/42 |
| 3,008,541 | A * | 11/1961 | Wachter | 96/40 |
| 3,581,468 | A * | 6/1971 | Gourdine et al. | 96/40 |
| 3,912,467 | A * | 10/1975 | Trump et al. | 96/94 |
| 4,065,275 | A * | 12/1977 | Kikuchi et al. | 96/51 |
| 4,539,022 | A * | 9/1985 | McLoughlin | 96/40 |
| 5,437,713 | A * | 8/1995 | Chang | 96/51 |
| 6,648,948 | B1 * | 11/2003 | Moriyama | 96/42 |
| 2005/0199125 | A1 * | 9/2005 | Taylor et al. | 96/39 |

FOREIGN PATENT DOCUMENTS

| | | | |
|---|---|---|---|
| EP | 0397208 | A2 * | 11/1990 |
| EP | 1050341 | A2 * | 11/2000 |

* cited by examiner

*Primary Examiner* — Richard L Chiesa
(74) *Attorney, Agent, or Firm* — Ladas & Parry LLP

(57) ABSTRACT

An electrostatic filter for the separation of dust particles has collecting electrodes fixed in a housing through which the gas flows and discharge electrodes arranged parallel to them and held stretched between insulators. For the cleaning of the collecting electrodes, a cleaning equipment is fixed to a cable having the discharge electrodes, which can be moved along the surface of the collecting electrodes to be cleaned by using a pulling device having a coiling drum.

8 Claims, 3 Drawing Sheets

ELECTROSTATIC FILTER

FIELD OF THE INVENTION

The invention concerns an electrostatic filter for the separation of dust particles from a gas stream with minimum one collecting electrode fixed in a housing through which the gas flows and with a discharge electrode arranged parallel to it at a distance, as well as the equipment for cleaning the collecting electrode working periodically.

BACKGROUND

For an electrostatic filter of this type mentioned in the EP 0397208, the collecting electrodes are cleaned periodically by shaking with resonance vibrations using electromagnets.

The EP 1050341 proposes a mechanical cleaning of the inner surface of its tubular collecting electrodes by swinging the discharge electrode, which is in the centre of the free tube section, i.e. coaxial, radially to the side up to the tube enclosure of the collecting electrode through a special mechanism, so that the way is free for a cleaning device, e.g., consisting of a brush, whose drive is not described in detail. The mechanisms consequently necessary for the sideways movement for the freeing of the tube section of the collecting electrode on one hand and for a cleaning movement along the length of the collecting electrode on the other hand require correspondingly large expenditure.

SUMMARY OF THE INVENTION

The object of the invention is to find an electrostatic filter of the type mentioned, which enables a good cleaning of the collecting electrode, which can be realized with compact and economical design with high reliability. This problem is solved according to the invention in that, the discharge electrode is part of a cable in which a cleaning equipment is fixed and this cable is connected to a drive system for the execution of a cleaning movement.

BRIEF DESCRIPTION OF THE DRAWINGS

Advantageous embodiments of the invention are subject of the dependent patent claims and the subsequent specifications to be drawn up based on the drawings. The figures show the following:

DESCRIPTION OF EXAMPLES FOR CARRYING OUT THE INVENTION

Figure 1:
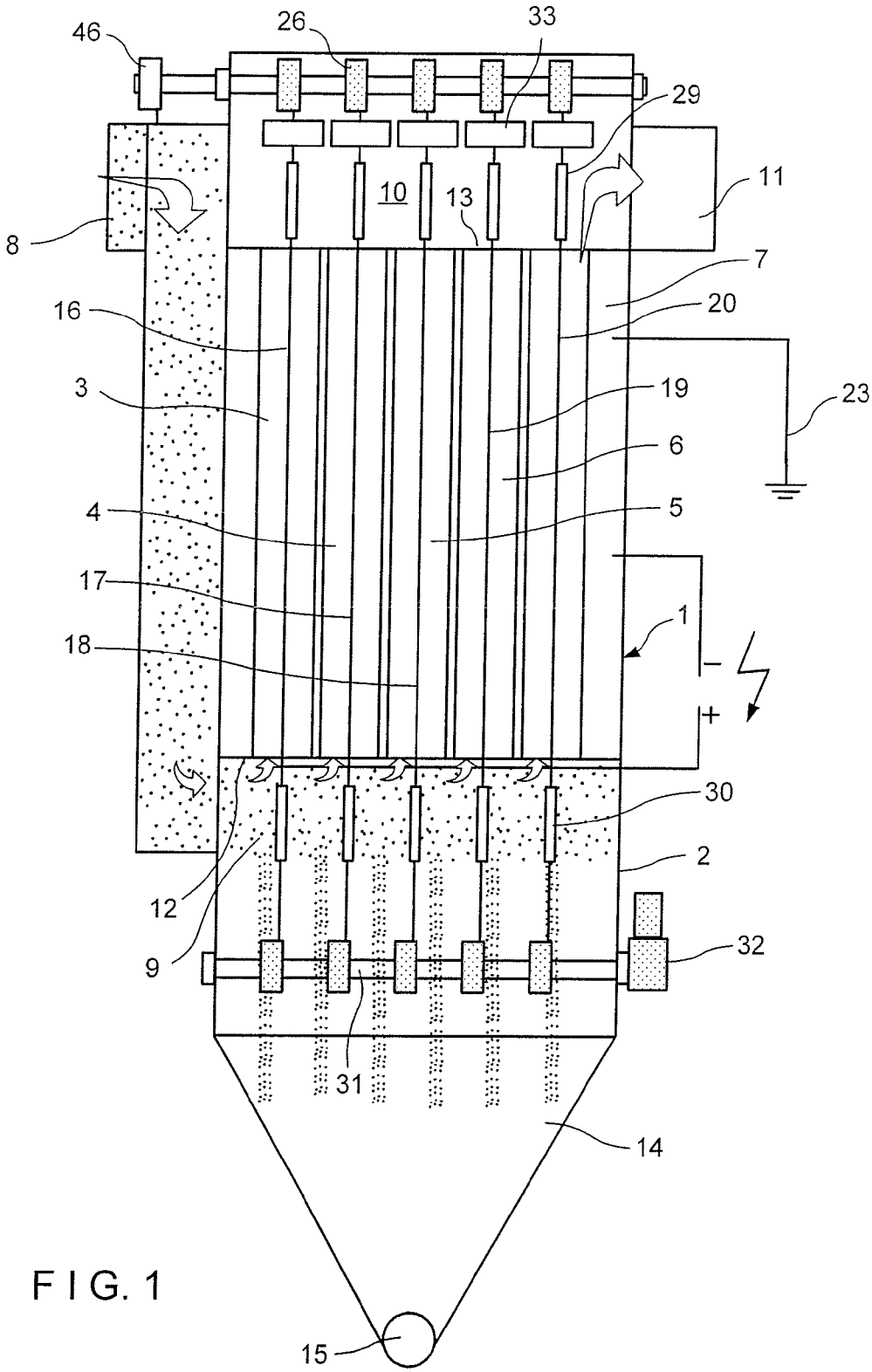
FIG. 1 a cross sectional view through an electrostatic filter according to the invention in schematic representation, FIG. 2 a bottom view of the electrostatic filter according to FIG. 1 in the area of its coiling drums, FIG. 3 a schematic overall representation of the mechanism for the execution of cleaning movement of a wire of an electrostatic filter according to FIG. 1 carrying a discharge electrode with a version illustrated by broken lines for the maintenance of a tension on such wires.

The electrostatic filter 1 represented has a box-shaped filter housing 2, which encloses a number of tubular collecting electrodes 3 to 7 running vertically and parallel to each other in several rows. The gas, coming, for example, as waste gas from a wood combustion plant, flows from an inflow connecting piece 8 to the floor area 9 of the housing to distribute itself from there to the individual collecting electrodes 3 to 7 from which it flows out into a head region 10 of the housing to leave this via an outflow connecting piece 11. The floor region 9 and head region 10 are separated by a lower and upper horizontal partition wall 12, 13 to which the ends of the collecting electrodes 3 to 7 are mounted in leak-proof manner. Towards the bottom, the filter housing 2 passes into a chute 14 defined by inclined walls, along the floor region of which a screw conveyor 15 stretches out, by which ash or dust, which is precipitated into the chute 14 from the collecting tubes 3 to 7 towards the bottom, is carried away.

A discharge electrode 16 to 20 consisting of a flexible wire stretched along the axis of each tubular collecting electrode 3 to 7 respectively, which is connected detachably to the positive pole of a high voltage source of, e.g., 40 kV. A contact frame 21 shown in FIG. 2 suspended in pendulum fashion on insulators (not shown), whose contact bars 22 are attached sideways to the discharge electrodes 16 to 20 respectively under own weight in an area projecting from the respective collecting electrode 3 to 7, is used. A steel rope system with winding spools 25 fixed to a common winding reel 24 is used as a solution for the electrical contact. The corresponding negatively charged collecting electrodes 3 to 7 are connected with an earth lead 23.

Each discharge electrode 16 to 20, stretching through a correlated collecting electrode 3 to 7, forms a part of a cable 28 running in the lengthwise direction to an upper and lower coiling drum 26, 27 respectively and can be wound on this. An upper and lower rod-shaped insulators 29, 30 are provided in this cable 28 for the electrical insulation from the coiling drums 26, 27.

The lower coiling drums 27 are connected to a rotary drive 32 via a common drive shaft 31 to pull a cleaning body 33, e.g., made in the form of a brush, provided above the collecting electrodes 3 to 7 in this cable 28 through the correlated tubular collecting electrode 3 to 7 respectively by winding the cable 28 on the coiling drum 27 and to remove thereby the material remaining adhered to its inner surface, so that it falls down into the chute 14.

In order to enable the winding of the cable 28 on the coiling drums 27 reliably in spite of the rod-shaped insulator 30 provided on the respective cable, a channel-shaped insulator receiver 34 is provided for this sideways to the coiling drum 27, which is restricted by an extension 35 of a sideways projecting drum hub 36. Besides, a crank arm 37 is provided, which extends away outwards in the channel direction and consequently tangentially from the drum hub 36, and, at whose outer end, an extension plug 39 of the insulator 30 is fixed via a ball and socket joint 40. Besides, the hub extension 35 and the crank arm 37 are matched in their length to the insulator 30 with its extension plug 39 in such a way that the turned end of discharge electrode 16 to 20 having a pivot 41 reaches the position of the sideways drum opening 42 in such a way on the swinging in of the insulator 30 into the insulator receiver 34 that the cable 28 with its discharge electrode 16 to 20 can be reliably wound on the coiling drum 27.

The cleaning process, carried out according to a certain time programme determined empirically as optimal, begins with the switching off of the electrical high voltage. Thereafter, the contact frame 21 is swung away from the discharge electrodes 3 to 7. Afterwards, the rotary drive 32 of the bottom coiling drums 27 is switched on. The respective crank arm 37 swings downwards through their rotation so that the rod-shaped insulator 30 settles in its receiver 34. The coiling drum 27 rotates further continuously and winds the discharge electrode 16 to 20 to such an extent till the cleaning body 33 has been pulled fully through the tubular collecting electrode 3 to 7.

The respective cable 28 at the upper end connected to the cleaning body 33 continues as steel rope 44 via a compensating spring 43, which is unwound at the same time by the upper coiling drum 26.

The upper coiling drums 26 of several discharge electrodes 16 to 20 are fixed on a common shaft 45, at the end of which a steel rope drum 46 is fixed. A counter steel rope 47 wound on this steel rope drum 46 is kept under tension through a weight 48 fixed at an end and consequently also maintains the tension of the discharge electrodes 16 to 20 via the shaft 45 during the cleaning process.

Figures 3, 4, 5:
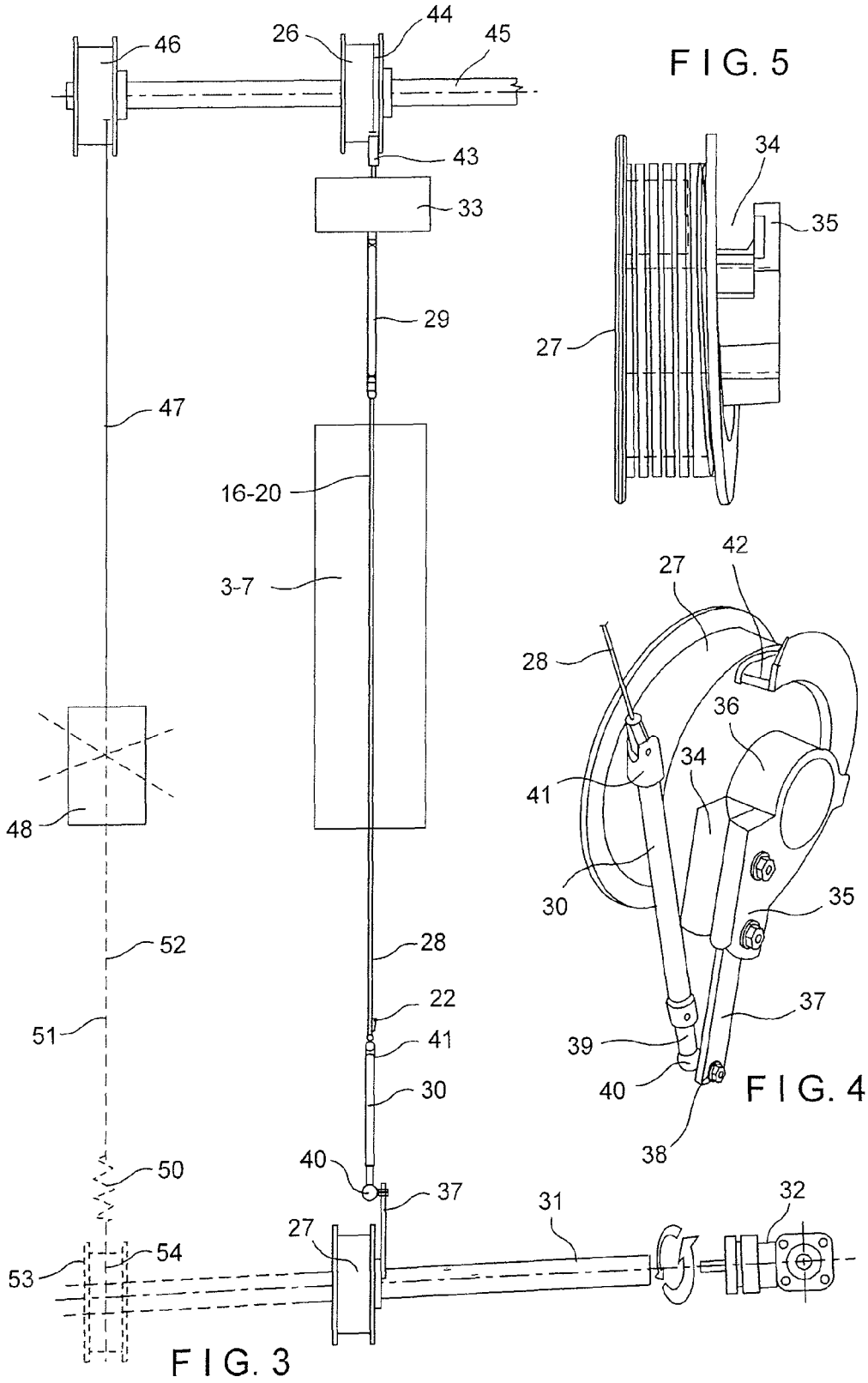
FIG. 4 a perspective representation of a coiling drum of electrostatic filter according to FIG. 1 and FIG. 5 a view of the coiling drum according to FIG. 4.

As illustrated in FIG. 3 by broken lines, the tension of the discharge electrodes 16 to 20 can be maintained, instead of through the weight 48, also through a tension spring 50, which is provided in a counter load rope 51. For this, the counter load rope 51 has a rope 52 extending from the upper steel rope drum 46 up to the tension spring 50 and a rope 54 wound on a counter pull drum 53. Besides, the winding rotation of this counter pull drum 53 is transmitted via the same shaft 31 as is provided for the coiling drum 27 because it is fixed on the same shaft 31. Only the winding direction is different, because through the described connection via the upper shaft 45, a winding of the cable 28 on the coiling drum 27 causes an unwinding of the rope 54 from the counter pull drum 53. Consequently, a pre-tension of the tension spring 50 permanently determines the tension of the discharge electrodes 16 to 20.

Figure 2:
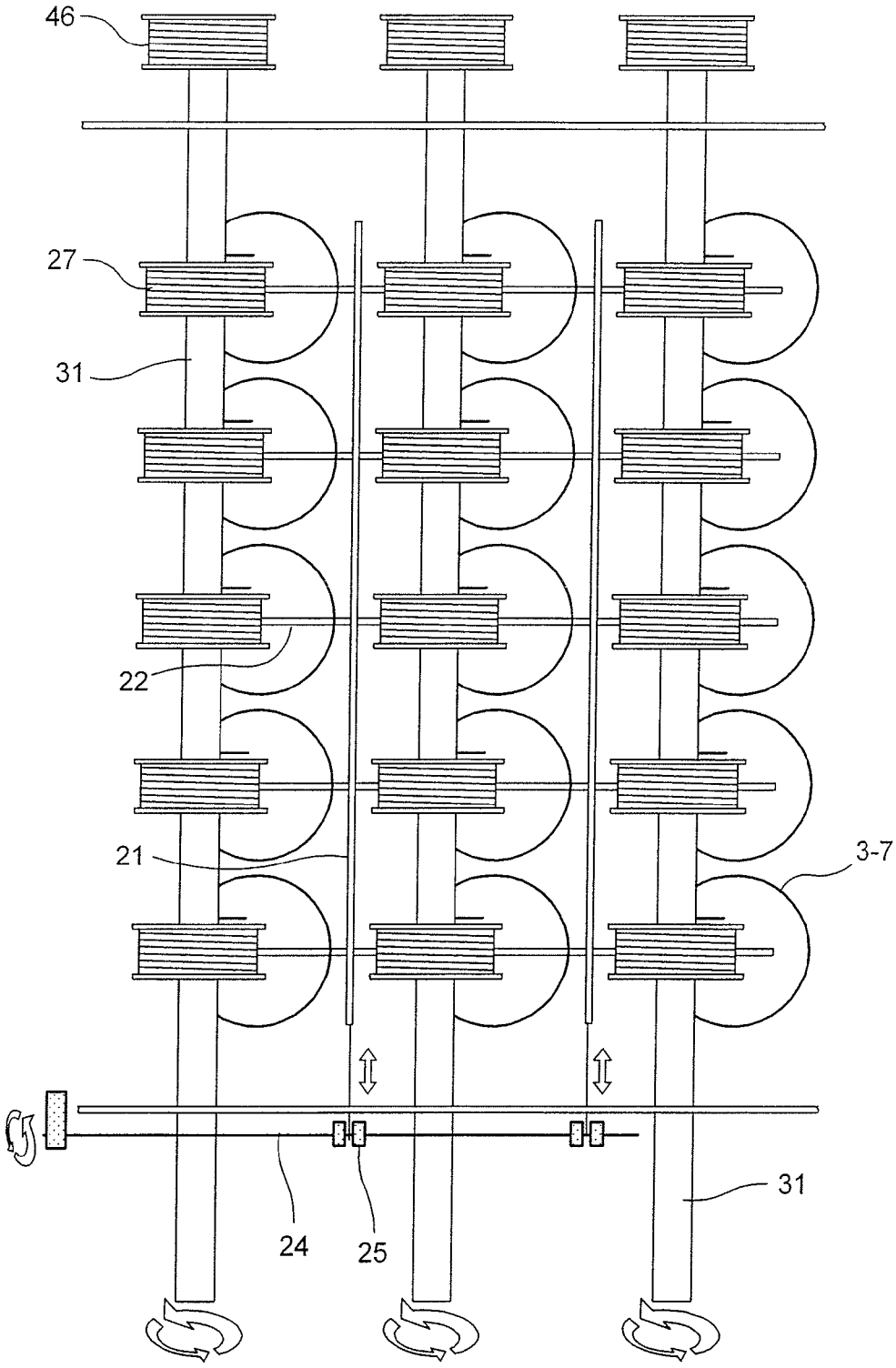

The representation of FIG. 2 illustrates that an electrostatic filter 1 built according to the described principle can be extended optionally through addition of further combinations of discharge electrode and collecting electrode both lengthwise as well as crosswise in order to be able to adapt for a certain case of application for given quantity of flow of gas to be cleaned by easy or economical method.

It is understood that the invention described based on an embodiment with tubular collecting electrodes can be applied also for electrostatic filters with electrodes executed differently, e.g., plate-shaped, with corresponding adaptation of the cross sectional form of the positive electrode, which can be preferably wound, to the form of the collecting electrode and also corresponding change of the cross sectional form of a coupled cleaning equipment.

The invention claimed is:

1. An electrostatic filter for the separation of dust particles from a gas stream with minimum one collecting electrode (3-7) fixed in a housing through which the gas flows and with a discharge electrode (16-20) arranged parallel to it at a distance, as well as equipment for the cleaning of the collecting electrode (3-7) working periodically, wherein the discharge electrode (16-20) is part of a cable (28) in which a cleaning equipment (33) is fixed and this cable (28) is connected to a drive system (27, 31, 32) for the execution of a cleaning movement, wherein at least a part of the cable (28) having the discharge electrode (16-20) can be wound on a coiling drum (27) for the execution of a cleaning movement of the cleaning equipment (33), and wherein the discharge electrode (16-20) is fixed between an upper and lower insulator provided in the cable (29, 30).

2. The electrostatic filter according to claim 1, wherein at least a part of the cable (28) having a plurality of discharge electrodes (16-20) can be wound on said coiling drum (27) for the execution of a cleaning movement of the cleaning equipment (33), each said discharge electrode stretched along the axis of a tubular collecting electrode and each extending between said upper and lower insulator.

3. The electrostatic filter according to claim 2, wherein an insulator receiver (34) as well as a crank arm (37) is provided sideways to the coiling drum (27), with whose outer end (38) said insulator (30) is connected via a pivot (40).

4. The electrostatic filter according to claim 3, wherein the insulator (30) has an end with a pivot (41) in the area of a sideways drum opening (42) of the coiling drum (27) in the swivelled position of the insulator receiver (34), in which the pivot (41) connects the insulator (30) to the discharge electrode (16-20).

5. The electrostatic filter according to claim 1, wherein the cable (28) having the discharge electrode (16-20) ends in a rope (44), which can be wound and unwound on an upper coiling drum (26), in which the coiling drum (26) is connected to a steel rope drum (46) via a shaft (45), whose rope (47) is held in tension through a weight (48).

6. The electrostatic filter according to claim 1, wherein the cable (28) having the discharge electrode (16-20) ends in a rope (44), which can be wound and unwound by an upper coiling drum (26) and this coiling drum (26) is connected to a steel rope drum (46) via a shaft (45), over which a cable (52) of a counter load rope (51) runs, in which this cable (52) ends at a tension spring (50) under pre-tension, and a second cable (54) connected to this can be unwound from a counter load drum (53), which is connected to the coiling drum (27) via a shaft (31) and consequently coupled to the rotary drive (32).

7. The electrostatic filter according to claim 1, wherein the collecting electrodes (3-7) are arranged in several rows next to each other in a common filter housing (2) having inflow and outflow connecting pieces (8, 11), in which the coiling drums (26) provided for the lengthwise movement of the discharge electrodes (16-20) are fixed on a common shaft (31, 45).

8. The electrostatic filter according to claim 1, wherein a rotary drive (32) connected to the coiling drum (27) is provided for producing the cleaning movement of the cleaning equipment (33) executed as brush.

* * * * *